US009655179B2

(12) United States Patent
Brandt

(10) Patent No.: US 9,655,179 B2
(45) Date of Patent: May 16, 2017

(54) LED DRIVER WITH ADVANCED DIMMING

(71) Applicant: TerraLUX, Inc., Longmont, CO (US)

(72) Inventor: Brian Eldin Brandt, Longmont, CO (US)

(73) Assignee: TerraLUX, Inc., Longmont, CO (US)

( * ) Notice: Subject to any disclaimer, the term of this patent is extended or adjusted under 35 U.S.C. 154(b) by 0 days.

(21) Appl. No.: 15/146,757

(22) Filed: May 4, 2016

(65) Prior Publication Data

US 2016/0330808 A1 Nov. 10, 2016

Related U.S. Application Data

(60) Provisional application No. 62/156,352, filed on May 4, 2015.

(51) Int. Cl.
*H05B 37/00* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC ..... H05B 33/0815; H05B 33/0839; H05B 33/0884; H05B 33/0875
USPC ..... 315/209 R, 247, 291, 307, 308, 185 R
See application file for complete search history.

(56) References Cited

U.S. PATENT DOCUMENTS

| | | | | |
|---|---|---|---|---|
| 7,888,886 | B2 | 2/2011 | Wu | |
| 8,487,546 | B2 * | 7/2013 | Melanson | H05B 33/0839 315/291 |
| 9,066,381 | B2 * | 6/2015 | Valois | H05B 37/0227 |
| 9,173,273 | B2 * | 10/2015 | Zudrell-Koch | H05B 37/02 |
| 9,307,601 | B2 * | 4/2016 | He | H05B 33/0815 |
| 2015/0237700 | A1 * | 8/2015 | Woytowitz | H05B 33/0863 315/307 |

* cited by examiner

*Primary Examiner* — Thuy Vinh Tran
(74) *Attorney, Agent, or Firm* — Neugeboren O'Dowd PC

(57) ABSTRACT

This disclosure describes systems, methods, and apparatus for an LED driver circuit capable of responding to dimmer signals from three different types of dimmers: a phase cut dimmer, a dedicated dimmer (e.g., 0-10V dimmer), and a button dimmer. The processor can include inputs for each of these dimmer types, and can be configured to determine which of the three types of dimmers is controlling the LED driver circuit, and determine which dimming signals to respond to when more than one dimmer type is trying to control the LED.

29 Claims, 10 Drawing Sheets

LED DRIVER WITH ADVANCED DIMMING

CLAIM OF PRIORITY UNDER 35 U.S.C. §119

The present application for patent claims priority to Provisional Application No. 62/156,352 entitled "LED Driver with Advanced Dimming" filed May 4, 2015, and assigned to the assignee hereof and hereby expressly incorporated by reference herein.

FIELD OF THE DISCLOSURE

The present disclosure relates generally to LED drivers. More specifically, but without limitation, the present disclosure relates to an LED driver circuit able to handle dimmer signals from multiple types of dimmers.

DESCRIPTION OF RELATED ART

LED lighting systems are capable of high light output while consuming significantly less power than that consumed by traditional incandescent bulbs. LEDs require a tightly regulated current supply, however, and thus LED lighting systems require more complex driver electronics than traditional systems in order to supply this current. In addition, LED lighting systems may be designed to interface with existing lighting infrastructure, such as traditional dimmer switches. A typical LED lighting system thus includes one or more LEDs and driver circuitry to power and dim the LEDs.

For the LED lighting market, as in many others, there is demand for a product that can serve many different needs of an end user. This demand is seen in particular for the lighting market in which LED lighting systems replace a variety of older lighting technologies, such as those that use incandescent or fluorescent bulbs. Space planners may, for example, wish to integrate or retrofit LED lighting systems into installations that have a mix of dimming, non-dimming, and various wattages of other bulb technologies to achieve a desired lighting effect or cost savings. A single product that fits all or most of these needs may be viewed as an advantageous alternative.

A number of different types of dimming exist, for example, button/switch dimming, phase-cut dimming, and 0-10 volt dimming. Button/switch dimming provides a selectable, quantized set of dimming levels that may be chosen to best fit the needs of the user or installation in terms of light output levels associated with each dimming level. For example, a set of light levels may be pre-programmed into a microcontroller, which sets the LED current and light output level in accordance with the dimming setting.

Additional features are desirable, however, to enhance the user experience. First, because the button press is momentary in contrast to a switch that is held in a particular position, the microcontroller in the driver must "remember" the light output level that is selected by the user. This remembering may be achieved by (e.g.) writing the light output position to non-volatile memory and fetching it upon power cycling of the light so that the LED light will always power on in that level.

Another dimming system is called phase-cut dimming, and operates by removing or chopping a portion of a current or voltage (such as an AC mains signal), thereby delivering a variable amount of power to the downstream LEDs. A TRIAC may be used to perform this chopping; the amount of the AC mains that is passed is referred to as the conduction angle, or phase, which may be measured in degrees; the leading edge or the trailing edge of the AC mains may be chopped. Another, similar approach is to generate a constant-voltage rail within the driver (independent of the phase-cut level), power the LED light therewith, and adjust the LED output current based on a measurement of the amount of input phase cut. This method allows for some advantages in that a microcontroller can have full control over the driven LED and be able to more easily interpret the presence or absence of a phase cut dimmer on the input.

0-10 volt dimming is typically used in commercial lighting installations in which dimming control over multiple lights is needed. This dimming method involves a dedicated set of control wires that can either be driven with a voltage control supply or can be passively dimmed with a potentiometer (or dimmer that mimics a potentiometer). Dimming may also be achieved via pulse-width modulation (PWM) sinking current from the positive (usually purple) wire with respect to the negative (usually grey) dim wire. This method can often offer smoother control of dimming since the input power to the driver is constant; there is also an advantage from an electromagnetic interference (EMI) standpoint.

Currently, products available on the market may offer only one or a subset of these dimming methods, thus requiring a number of different products or types of products in order to meet the needs of a customer or installation. Of those, the prior art appears to select a dimming type at turn-on and then control a light based only on that dimming type from there on out. A need therefore exists for a system that is compatible with all dimming methods to give the customer greater flexibility and reduce costs.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some aspects of the disclosure may be characterized as an LED driver circuit having an AC mains connection, one or more power conversion components, a phase cut detection component, a dedicated dimmer input, a button dimming input, a processor, and a memory. The one or more power conversion components can include at least a constant current source for driving the one or more LEDs. The phase cut detection component can be configured to monitor for a phase cut voltage on the AC mains connection. The dedicated dimmer input can be configured to monitor for a dedicated dimming voltage from a dedicated dimmer. The button dimming input can be configured to monitor for a button dimming signal from a button dimmer. The processor can have one or more processing components. It can be coupled to the phase cut detection component, the dedicated dimmer input, and the button dimming input. The memory can have a non-transitory, tangible processor executable code stored on therein. When this code is executed on the processor it causes the processor to control the constant current source based on the phase cut voltage, the dedicated dimming voltage, the button dimming signal, or a combination of the dedicated dimming voltage and the button dimming signal.

Other aspects of the disclosure may also be characterized as a method of operating an LED driver circuit. The method can include monitoring a phase of an AC mains signal for a phase cut dimming signal. The AC mains signal can provide power to the LED driver circuit. The method can also include monitoring a dedicated dimming input for a dedicated dimming signal. The method can further include monitoring a button dimming input for a button dimming signal. The method can further include determining whether a phase cut dimmer, a dedicated dimmer, a button dimmer, or some combination of these is attempting to control the LED brightness. The method can further include controlling a constant current source of the LED driver circuit based on the phase cut voltage, the dedicated dimming voltage, the button dimming signal, or a combination of the dedicated dimming voltage and the button dimming signal.

Other aspects of the disclosure can be characterized as non-transitory, tangible processor readable storage medium, encoded with processor readable code to perform a method for controlling an LED driver circuit. The method can include monitoring a phase of an AC mains signal for a phase cut dimming signal. The AC mains signal can provide power to the LED driver circuit. The method can also include monitoring a dedicated dimming input for a dedicated dimming signal. The method can further include monitoring a button dimming input for a button dimming signal. The method can further include determining whether a phase cut dimmer, a dedicated dimmer, a button dimmer, or some combination of these is attempting to control the LED brightness. The method can further include controlling a constant current source of the LED driver circuit based on the phase cut voltage, the dedicated dimming voltage, the button dimming signal, or a combination of the dedicated dimming voltage and the button dimming signal.

Other aspects of the disclosure can be characterized as an LED driver circuit comprising a processor and a memory. The processor can have one or more processing components and the processor can be coupled to a phase cut detection component, a dedicated dimming input, and a button dimming input. The memory can have non-transitory, tangible processor executable code stored on the memory that when executed on the processor causes the processor to adjust an LED drive current by deciding how to generate an LED control signal based on a power monitored by the phase cut detection component, or based on manual intervention indicated via the dedicated dimming input, the button dimming input, or a combination of the dedicated dimming input and the button dimming input.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

The present disclosure relates generally to LED drivers. More specifically, but without limitation, the present disclosure relates to an LED driver circuit able to handle dimmer signals from multiple types of dimmers. In an embodiment, an LED driver circuit is disclosed that can dim an LED based on dimming signals from a phase cut dimmer, a dedicated dimmer (e.g., 0-10V dimmer), and a button dimmer coupled to the LED fixture. In this way, only a single LED driver circuit is needed despite the possibility that the LED driver circuit may be coupled to any one or more of these varied dimmer types. The present disclosure also enables different dimmer types to be recognized in real time and the method of controlling the LED to change on the fly. Existing products that select and stick to a certain dimmer type from turn-on are not amenable to all user applications, since a manufacture cannot predict every use application, and especially where dimmer types may change or only become apparent after turn-on, the static nature of prior art designs is sub-optimal.

The word "exemplary" is used herein to mean "serving as an example, instance, or illustration." Any embodiment described herein as "exemplary" is not necessarily to be construed as preferred or advantageous over other embodiments.

Figure 1:
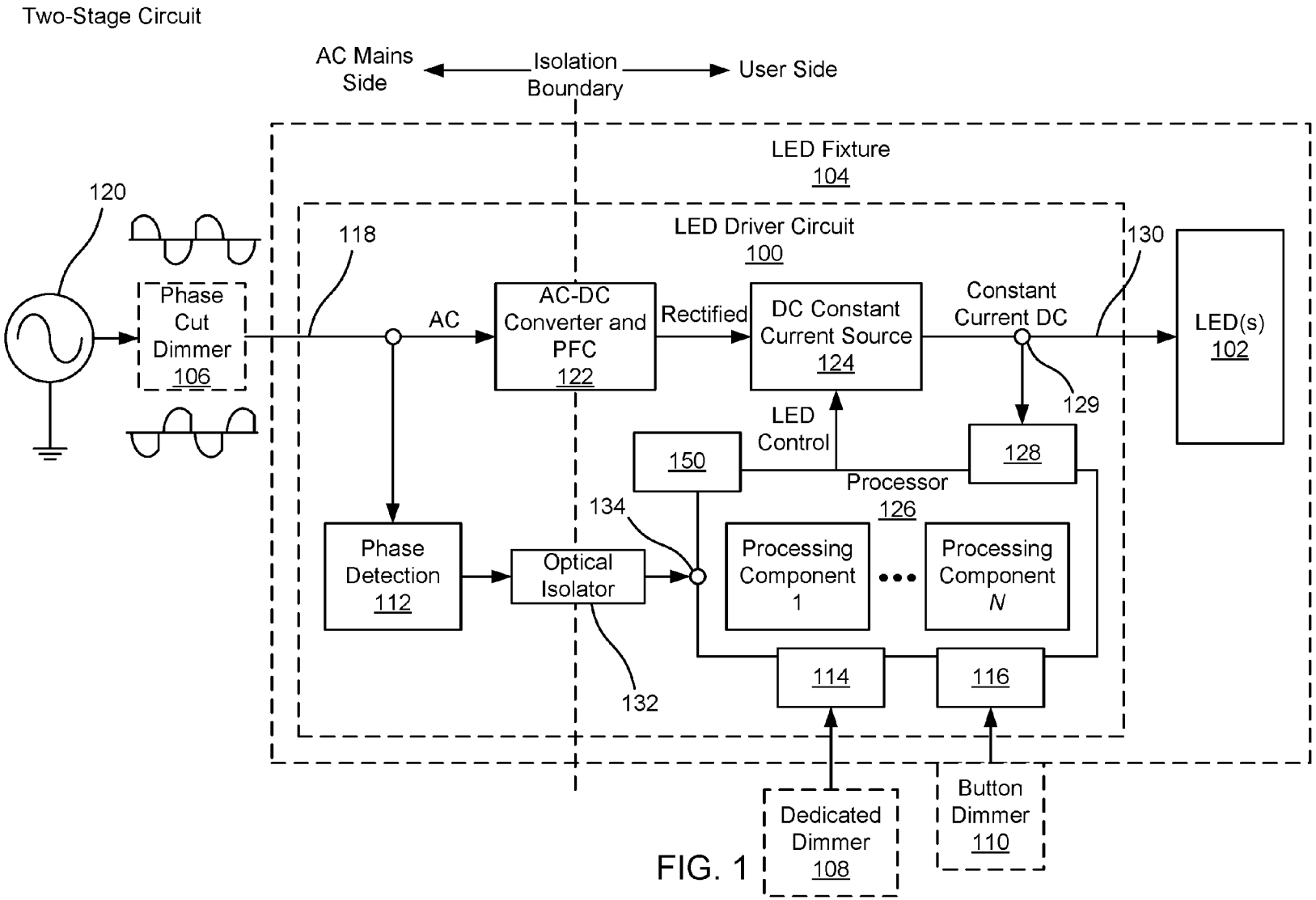
FIG. 1 illustrates one embodiment of an LED system including an LED driven by an LED driver circuit.
Figure 2:
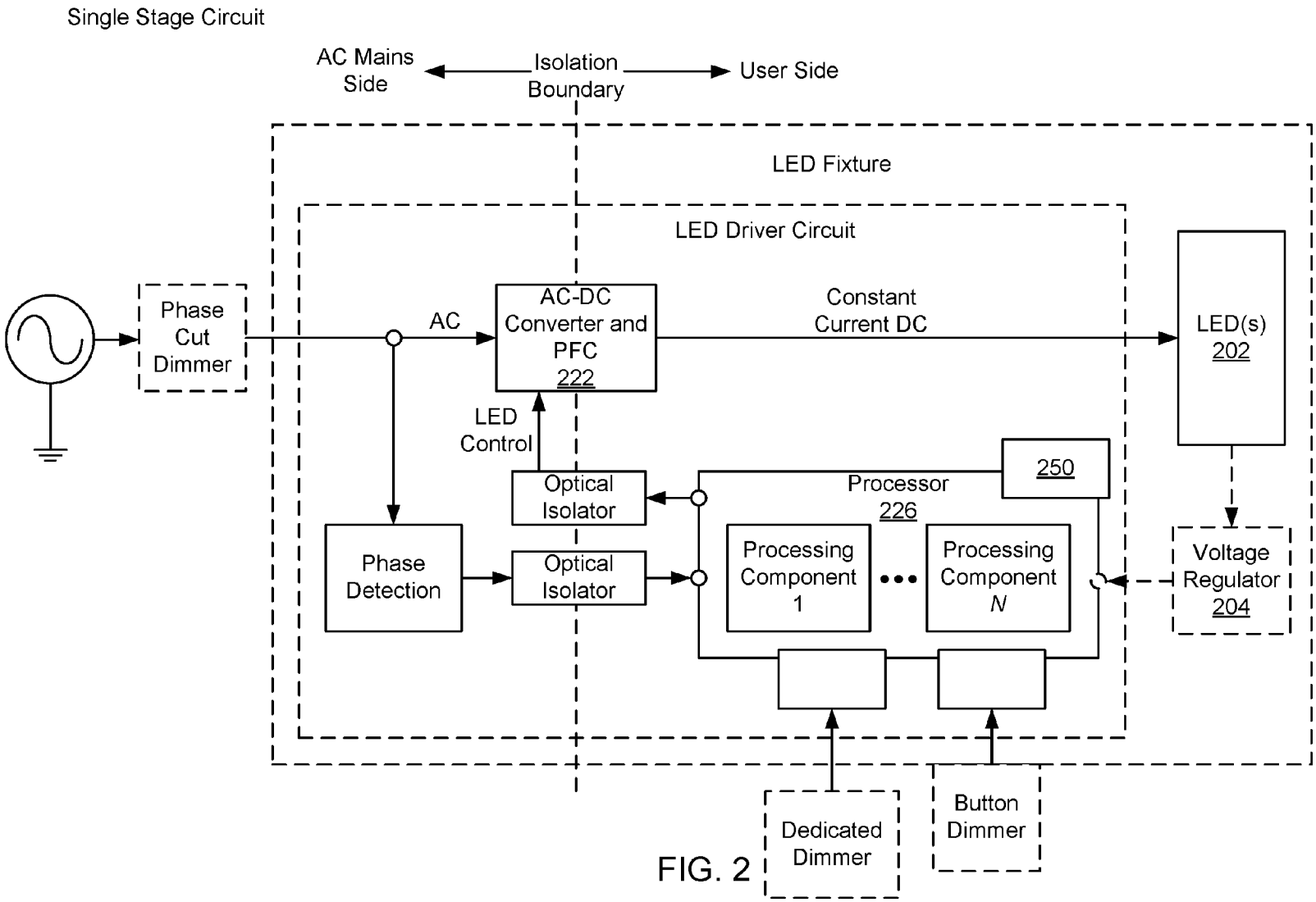
FIG. 2 illustrates another embodiment of an LED system including an LED driven by an LED driver circuit.
Figure 3:
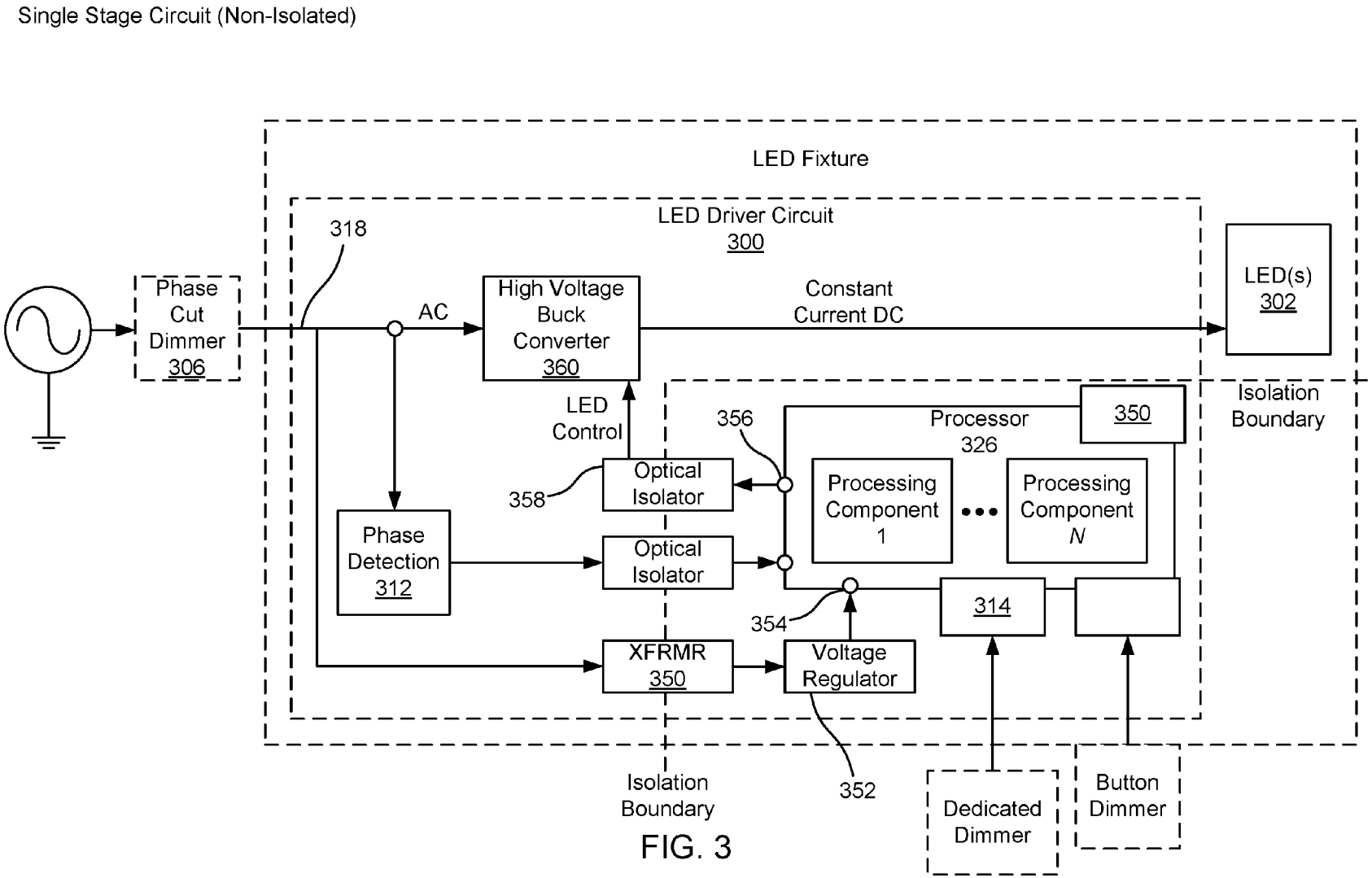
FIG. 3 illustrates yet another embodiment of an LED system including an LED driven by an LED driver circuit.

FIGS. 1-3 illustrate block diagrams of three different LED driver circuits in accordance with embodiments of the present disclosure. These various drivers are all compatible with three types of dimming control systems: dedicated dimming (e.g., 0-10V, DALI, pulse-width modulation), phase cut dimming, and physical or digital relay dimming (e.g., buttons, switches, capacitive touch inputs, etc.). Throughout this disclosure reference will be made to an LED driven by an LED driver circuit. However, those of ordinary skill in the art will recognize that the driven LED can be replaced by one or more LEDs arranged in any combination of series or parallel configurations without departing from the spirit or scope of the disclosure. Therefore, the remainder of this disclosure will refer to driving a single LED, even though this terminology is intended to mean "one or more LEDs."

The LED drivers disclosed herein may include any combination of digital and analog circuitry in the form of MOSFET, BJT, or other transistors, diodes, capacitors, inductors, resistors, or similar circuit elements. The LED driver may include a driver circuit or constant current source for driving the LED(s) at a constant current, the magnitude of the constant current related to a brightness of the LED(s), a feedback circuit for measuring LED(s) current (e.g., an output of the constant current source), a thermal circuit for measuring or inferring LED(s) temperature and for adjusting the LED(s) current accordingly, sensing circuits for detecting button presses, or any other similar circuits. The LED driver may further include a digital or analog controller or processor configured for executing the embodiments of the disclosure described herein; instructions for the processor may be stored in a non-volatile memory, such as a flash memory or ROM, in volatile memory (such as RAM), or may be hard-wired into the controller itself (i.e., implemented as hardware components). In some embodiments, the LED driver is used in conjunction with other LED components, such as a rectifier, transformer, current sensors, phase detector, temperature sensor, buck/boost converter, or voltage or current regulator; in other embodiments, the LED driver includes some or all of those components or functionality thereof. Embodiments of the LED driver are shown in FIGS. 1-3.

FIGS. 1-3 each show three optional dimming inputs: a phase cut dimmer, a dedicated dimmer (e.g., 0-10V dimmer), and a button dimmer. While these dimmers are each optional, the LED driver circuit includes inputs for all three dimmer types regardless as to whether all three dimmer types are coupled to these inputs.

FIG. 1 illustrates one embodiment of an LED system including an LED driven by an LED driver circuit. This embodiment shows a two-stage driver circuit 100 with isolation between the AC mains side of the isolation boundary and a user side of the boundary. The isolation, for instance galvanic isolation, protects users who may contact the LED 102 and other exposed parts of an LED fixture 104, from contact with high voltages and currents that may exist on the AC mains side of the isolation boundary. The LED driver circuit 100 is considered two-stage since AC mains power is first converted to DC power and then converted to a constant current signal for driving the LED 102. In a single-stage LED driver, a single component or sub-system both converts the AC power to DC and regulates a constant current output for driving an LED.

The LED driver circuit 100 includes an AC mains connection 118 providing AC power from an AC mains 120 to the LED driver circuit 100. The AC mains connection 118 is coupled to an AC-DC converter and power factor correction sub-system 122. The AC-DC converter portion of the sub-system 122 can include rectifying circuitry, such as a full-bridge rectifying circuit, having components arranged to convert the AC power to a rectified power signal. The power factor correction portion of the sub-system 122 can regulate the rectified power signal in order to improve or optimize a power factor of the LED driver 100 (e.g., a power factor that approaches 1 and a total harmonic distortion (THD) that approaches 0). The rectified power signal can be provided to a DC constant current source sub-system 124. The DC constant current source sub-system 124 can generate a constant current DC output that is provided to the LED 102 to drive the LED. A processor 126 (e.g., microcontroller) can provide an LED control signal to the DC constant current source sub-system 124 controlling the constant current DC output and thereby controlling a brightness of the LED 102. The processor 126 can set and adjust the LED control signal based on feedback and dimming signals from one or more types of dimmers (e.g., phase cut, dedicated, and button-type) as will be discussed in detail below.

The AC mains connection 118 can also be phase cut dimmer input, since the phase cut dimming signal is embedded in the AC mains signal. A phase detection component 112 can monitor for a phase cut dimming signal on the AC mains connection 118 or at an input to the AC-DC converter and PFC 122, and further monitor the phase cut dimming signal when one exists. An optional phase cut dimmer 106 can be arranged on the AC mains connection 118 and can embed a phase cut dimming signal in the AC mains power by chopping front or rear portions of each half cycle of the AC mains power. In the illustrated embodiment, the phase detection component 112 can be arranged within the LED driver circuit 100, but on an AC mains side of the isolation boundary. The processor 126 is arranged on the user side of the isolation boundary, so an optical isolator 132 can be used to pass signals from the phase detection component 112 to the processor 126 across the isolation boundary. An optical isolator 132 is an electro-optical device that converts electrical signals to optical signals, passes the optical signals across an electrical isolation boundary, and then converts the optical signals back into electrical signals. In this way, an optical isolator 132 allows signals to cross the isolation boundary without disrupting the isolation boundary (i.e., without shorting the AC mains side to the user side. Put another way, the optical isolator digitizes the analogue signal detected by the phase detection component 112 or converts the sinusoidal AC signal on the AC mains connection 118 to a square wave where a duty cycle of the square wave corresponds to the on-time of the phase cut dimming signal. As the dimming is increased, a greater portion of each half cycle is chopped or forced to 0 V. Details of the phase detection component 112 will be shown in FIG. 6.

An optional dedicated dimmer 108 can be coupled to a dedicated dimmer input 114 that includes circuitry and/or components that monitor for a dedicated dimming signal and monitor such a signal when present. The dedicated dimmer input 114 can be part of the processor 126 or separate therefrom, and can provide a dedicated dimming signal to the processor 126 if not part of the processor 126. Dedicated dimmer 108 can include, but is not limited to, a 0-10V dimmer, a pulse-width modulation (PWM) dimmer, a digital addressable lighting interface (DALI) dimmer. For a 0-10V dimmer, the dedicated dimmer 108 provides a voltage signal between 0-10V, with different voltages representing a percentage of full brightness that a user desires to set the LED brightness to. For instance, a 5V signal would indicate a desire for 50% brightness, while a 10V signal would indicate a desire for 100% brightness. These are illustrative values only, and the actual values in implementation may vary. 0-10V dimmers can either be active or passive. Active 0-10V dimmers include a variable source, while passive 0-10V dimmers instead have a variable resistance. Because there are two types of 0-10V dimmers, and because passive 0-10V dimmers do not source power, the dedicated dimmer input 114 includes a bias since such a bias may be needed to read the setting of a passive 0-10V dimmer. This also explains why the dedicated dimmer input 114, when implemented for a 0-10V dimmer, looks at a voltage provided by the dimmer, rather than the mere existence of a signal (e.g., a passive 0-10V dimmer does not provide a signal unless the dimmer input has a bias). Since a setting of 10V on a 0-10V dimmer indicates full LED brightness, the dedicated dimmer input 114, when implemented for a 0-10V dimmer, may only need to look for voltages below 10V, since a dimmer setting of 10V is effectively the same as if no dimmer were attached, and hence the processor 126 need not enter a specific mode when the 0-10V dimmer is set to 10V. Unlike the phase cut dimming signal, which is embedded in the AC power signal, the dedicated dimming signal arrives via one or more connections that may be dedicated to the dedicated dimming signal. Details of the dedicated dimmer input 114 will be shown in FIG. 7.

An optional button dimmer 110 can be coupled to a button dimmer input 116 that includes circuitry and/or components that monitor for a button dimming signal and monitor such a signal when present. The button dimmer input 116 can be part of the processor 126 or separate therefrom, and can provide a button dimming signal to the processor 126 if not part of the processor 126. The button dimmer 110 can include a button, switch, relay, rotatable knob, capacitive touch sensor, or any other component that detects physical user contact. In some embodiments, the button dimmer 110 can include a user interface of a mobile device, such as a smartphone or tablet computer, and the button dimming signal may be sent via wired or wireless connection from the mobile device to the LED driver circuit 100. The button dimmer 110 can be integral with or coupled to the LED driver circuit 100, but can also be remote from the LED driver circuit 100. The button dimmer 110 can pass a button dimming signal to the button dimming input 116 via either a wired or wireless connection. The button dimmer 110 may be coupled to or part of the LED fixture 104. Activation of the button dimmer 110 may be used to set a dimming level, or to set a maximum or minimum dimming level. For instance, the button dimmer 110 can be used to set a maximum or minimum dimming level and the dedicated dimmer 108 could be used to select a dimming level within the range established via the button dimmer 110. Details of the button dimmer input 116 will be shown in FIG. 8. Unlike the phase detection component 112 and the dedicated dimmer input 114, the button dimmer input 116 looks at a state of the button dimmer 110 rather than a variable signal. The button dimmer input 116 can include a pull-up resistor in series with a pull-up voltage or some other biasing circuit to enable switching of the button dimmer 110 to create a button dimming signal that can be detected by the processor 126.

A current detection component 128 can be coupled to an output 130 of the DC constant current source sub-system 124. The current detection component 128 can include circuitry and/or components that monitor electrical characteristics of the output 130 (e.g., current, voltage, phase, reflected power, forward power). The current detection component 128 can monitor the output 130 and provide feedback to the processor 126 that the processor 126 can use to control the DC constant current source sub-system 124. For instance, this feedback loop can be used to provide a more accurate and consistent LED 102 brightness. Details of the current detection component 128 will be shown in FIG. 8.

The processor 126 can optionally include one or more processing components, 1-N and inputs for receiving feedback regarding electrical characteristics of the output 130 (the current detection component 128), and inputs for receiving dimming signals from one or more of the phase detection 112, dedicated dimmer input 114, and button dimmer input 116. For instance, the processor 126 can include a phase detection input 134 coupled to the optical isolator 132 and configured to receive phase cut dimming signals from the phase detection component 112. Details of the processor 126 will be shown in FIG. 5.

The components and arrangement of FIG. 1 is not limited to a two-stage circuit, and FIGS. 2 and 3 illustrate two non-limiting alternatives of LED driver circuits able to interoperate between three different dimmer signals: phase cut, dedicated, and button-type.

The LED driver circuit 110 and LED fixture 104 are optional constraints, as there are embodiments, where the components of the LED driver circuit 100 may have different physical arrangements and boundaries than those shown in FIGS. 1-3.

The following description provides further detail regarding the operation of the LED driver circuit 100 of FIG. 1. This description also makes reference to the method illustrated in FIG. 4. Effectively, the LED driver circuit 100 monitors three dimming inputs, determines whether a phase cut dimmer, a dedicated dimmer, a button dimmer, or a combination of these, is attempting to control the LED brightness, and then controls a constant current source of the LED driver circuit 100 based on a phase cut voltage on an AC mains connection, a dedicated dimming voltage at a dedicated dimming input, a button dimming signal at a button dimming input, or a combination of the dedicated dimming voltage and the button dimming signal. In one embodiment, when the LED driver circuit 100 is powered on, it checks the state of the dedicated dimmer input 114 to see if a dedicated dimmer 108 is providing a dedicated dimming signal. If the dedicated dimmer input 114 is receiving a dedicated dimming signal, that optionally meets certain parameters (e.g., a 0-10V dimming signal that is greater than 0V, but less than 10V), then the LED driver circuit 100 determines that a dedicated dimmer 108 is connected (Decision 402 in FIG. 4) and therefore enters a dedicated dimmer mode (Block 404) and dims the LED 102 according to the dedicated dimming signal (e.g., controlled by a position of the dedicated dimmer 108). For instance, the dedicated dimmer could be a 0-10V dimmer, in which case, the dedicated dimmer input 114 may look for a voltage between 0 V and 10 V. Voltages at or above 10V can indicate that there is no 0-10V dimmer or there is a 0-10 V dimmer but it is configured to be full on (i.e., no dimming). The dedicated dimmer input 114 is described in more detail in FIG. 7 and includes an output that is coupled to a dedicated dimming input terminal or pin 508 of the processor 500 illustrated in FIG. 5.

To provide more flexibility to the user, a combination of the dedicated dimming mode and the button-dimming modes is provided. While the processor 126 is set to the dedicated dimming mode (Block 404), the LED driver circuit 100 can begin checking a state of the button dimmer input 116 to see if a button dimming signal from a button dimmer 110 is in use (Decision 406). This check loops as long as the processor 126 mode is set to the dedicated dimmer mode and as long as no button dimmer 110 is detected. If a button detector 110 is detected at the button dimmer input 116 (Decision 406), then the LED driver circuit 100 sets a maximum LED 102 brightness based on the button dimming signal from the button dimmer 110 (Block 408). The button dimmer 110 enables a user to select between a fixed or variable set of dimming levels using an input button(s), dial, or any other input device in accordance with the unlocking/locking procedure previously described. In an embodiment, the maximum LED 102 brightness is set via a pressing and holding of the button dimmer, or some other physical contact followed by holding. The processor 126 may store this maximum LED 102 brightens in a memory 150. Confirmation may be indicated by, for example, flashing a pattern on the lamp. If this maximum LED 102 brightness is set, then the LED driver circuit 100 can continue monitoring for an additional button dimming signal (Block 406) until another button dimming signal is received (e.g., changing the maximum LED 102 brightness), or until the processor 126 is set to another mode.

Given the maximum LED 102 brightness, the processor 126 may control the LED 102 brightness proportionately to the dedicated dimming signal between the minimum LED 102 brightness (e.g., fully off) and the new maximum LED 102 brightness (as set by the user). If the user desires to reset the maximum LED 102 brightness back to the default, the user may, for example, reduce the maximum LED 102 brightness below a threshold value that triggers the reset. For instance, a value corresponding to a 1 V setting of a 0-10 V dimmer input could be the threshold. When the LED 102 brightness is moved below this via holding of the button dimmer 110, the processor 126 can reset the stored maximum LED 102 brightness level to the maximum value (e.g., corresponding to 10 V on a 0-10 V dimmer input). Confirmation of the reset may be indicated through flashing a pattern on the LED 102.

The button dimmer 110 may be disposed on the LED driver circuit 100, on the LED fixture 104 (as illustrated), or any other location (such as near a wall switch) and connected to the LED driver circuit 100 via one or more conducting wires or wirelessly (via, for example, Wi-Fi or BLUETOOTH). In some embodiments, a conventional wall switch acts in lieu of the button dimmer 110; the user may operate the LED 102 brightness as described above with switch toggles instead of button presses. For example, if the user wishes to change the LED 102 brightness, he or she may toggle the wall switch from on to off to on to perform the function of the button press described above. In one embodiment, the on-to-off-to-on toggle must be performed within a certain time limit (e.g., one second) in order for the LED driver circuit 100 to register it as a button press. The press-and-hold functions described above may be performed by an on-to-off-to-on toggle having a duration greater than the first threshold but less than a second threshold (e.g., greater than one second in duration but less than two seconds). In another embodiment, the press-and-hold functions are performed by executing a plurality of short-duration toggles in a certain duration of time (e.g., two on-to-off-to-on toggles in less than two seconds). Off-to-on-to-off toggles may similarly be recognized as button presses.

Where a dedicated dimming signal does not exist (Decision 402), the LED driver circuit 100 checks a state of the phase detection component 112 to see if a phase cut dimming signal is detected on the AC mains connection 118 (Decision 410). If there is a phase cut dimming signal, then the phase detection component 112 passes this information through the optical isolator 132 to the processor 126 and the processor 126 sets its mode to a phase cut dimming mode (Block 412). Optionally, the processor 126 can also ignore any dimming signals from the other dimmer inputs 114, 116. In other words, when the processor 126 mode is set to phase cut dimming, the processor may ignore any dimming signals from the dedicated dimmer 108 and the button dimmer 110. This is because, if a set of LEDs is dimmed substantially via button dimming, and being driven via phase cut dimming, the total load of the set of LEDs may fall to an unacceptable point that could cause flickering of the LEDs. To avoid this, button dimming and dedicated dimming are disabled whenever phase cut dimming is detected. When in the phase cut dimming mode, the processor 126 can receive indications of a desired dimming amount from the phase detection component 112 based on the phase cut measured on the AC mains connection 118. The processor 126 can then control the DC constant current source sub-system 124 based on the indications of the desired dimming amount.

In an embodiment, the phase detection component 112 can monitor a conduction time or phase angle of the AC power on the AC mains connection 118. If the conduction time is below a threshold (e.g., less than 100% or 90% of the total time of conduction), the LED driver circuit 100 can detect that the LED 102 is controlled by a phase cut dimmer 106. In one embodiment, phase-cut dimmers do not allow full phase angle conduction of the AC power on the AC mains connection 118 during normal operation, and this inherent feature of certain phase-cut dimmers allows the phase detection component 112 to determine that a phase-cut dimmer is coupled to the LED driver circuit 100 even when the dimmer is calling for full LED brightness. In other words, some reduction in the on-time is always present event when the phase-cut dimmer is at its highest setting. In contrast, 0-10V dimmers may provide the same voltage whether they are at maximum (i.e., 10V) or whether no dimmer is connected (i.e., still 10V), and thus it can be difficult to determine if a 0-10V dimmer is coupled to the LED driver circuit 100 and is at its highest level, or if no 0-10V dimmer is coupled to the LED driver circuit 100.

Where a phase cut dimming signal is not detected by the phase detection component 112 (Decision 410), the processor 126 can be set to a button dimming mode (Block 414). For instance, and assuming the phase detection component 112 looks at conduction time and compares this to a threshold, if the conduction time is above a fixed threshold, the LED driver circuit 100 detects that there is no phase cut dimmer 106, and the LED driver circuit 100 then defaults to the button-dimming mode (Block 414). In the button-dimming mode, the processor 126 monitors a button dimming signal from the button dimming input 116 indicating user changes input via the button dimmer 110 (Decision 416). When such button dimming signals are received, the processor 126 changes an output of the DC constant current source sub-system 124 based on these signals (e.g., changes the LED 102 brightness) (Block 418).

Button-dimming mode of the processor 126 (Block 414) may be the default mode for the LED driver circuit 100 when there is no other dimming source connected (e.g., detected). Any phase conduction angle information detected by the phase detection component 112 may be ignored while in this mode. The button dimmer 110 enables a user to select between a fixed or variable set of dimming levels using an input button(s), dial, or any other input device in accordance with the unlocking/locking procedure previously described. In some embodiments, however, when in button-dimming mode, the processor 126 monitors the dedicated dimming input 114 to detect if a dedicated dimmer 108 has been connected since the button dimmer 110 was engaged, or was previously connected but set to full power and has now been dimmed (Block 420). Upon detection, the processor 126 leaves the button-dimming mode and switches to the dedicated dimming mode (Block 404). The processor 126 can then operate in dedicated dimming mode as described above (Block 404, Decision 406, Block 408).

Figure 4:
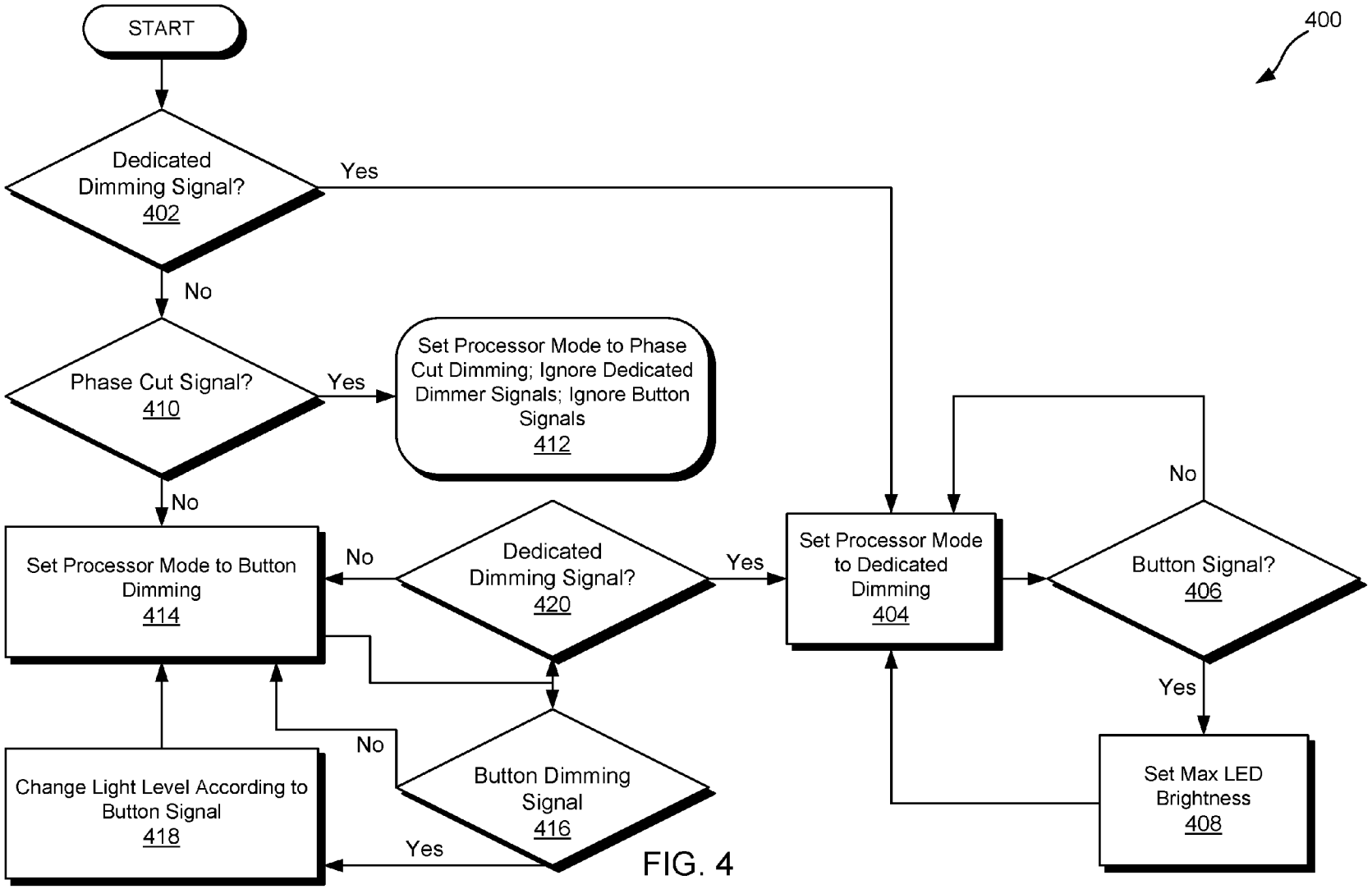
FIG. 4 illustrated an embodiment of a method for driving one or more LEDs based on a plurality of dimmer types.

It should be understood, that once the processor mode is set to button dimming mode (Block 414), the method 400 illustrated in FIG. 4 can monitor for the button dimming signal (Decision 416) and the dedicated dimming signal (Decision 420) at the same time, with some periodicity, or in some order (e.g., dedicated dimming signal first and then button dimming signal, or vice versa).

In some cases, handling or adjustment of the LED driver circuit 100 and/or LED fixture 104 and/or LED 102 may cause an inadvertent or unintentional pressing of the button or other trigger of the button dimmer 110, thus undesirably changing the brightness of the LED 102. In one embodiment, a button-lockout feature eliminates or mitigates this behavior. By default, if the button dimmer 110 is pressed, the LED driver circuit 100 does not cause any changes to the LED 102 brightness. If the user wishes to change the LED 102 brightness, in one embodiment, the user must press and hold the button dimmer 110 for a predetermined amount of time (e.g., four seconds). After the predetermined duration of continuously depressing the button dimmer 110, the LED driver circuit 100 determines that an LED 102 brightness change is being initiated. At this time, the LED driver circuit 100 may blink the LED 102 off and then back on in a particular pattern (one blink, for example) to indicate that the button dimmer 110 is "unlocked" and is ready to change the LED 102 brightness. At this time, the user may "cycle" through the fixed light levels by, for example, repeatedly pressing the button dimmer 110 as many times as needed or desired. If, at any time, the button dimmer 110 is not pressed for a predetermined amount of time (i.e., the lock timeout period), e.g., four seconds, the processor 126 may be configured to interpret this lack of pressing as a desire to "lock in" the setting level that the LED 102 is currently in. This "locking" may be indicated by a particular pattern of light blinks (two blinks, for example). This locking sequence may be disabled in certain circumstances, e.g., as long as the user is selecting different LED 102 brightness levels at time intervals less than the lock timeout period.

It should be recognized that the herein disclosed embodiments enable the LED driver circuit 100 to be operable with any one or more of the phase cut dimmer 106, the dedicated dimmer 108, and the button dimmer 110. This means that any one or more of these dimmers 106, 108, 110 may be coupled to the LED driver circuit 100 and the LED driver circuit 100 includes circuitry and executable instructions for responding to different dimming signals and even multiple dimming signals at once. The advantage is that different LED driver circuits are not needed for different dimmer types.

The processor 126 can include a memory 150, or can be coupled to the memory 150. Non-transitory tangible processor readable code can be stored on the memory 150 that when executed on the processor 126 causes the processor 126 to carry out the above-described methods. For instance, such code, when executed on the processor 126, can cause the processor 126 to determine which of the three modes to enter based on one or more inputs from the phase detection component 112, the dedicated dimming input 114, and the button dimming input 116.

FIGS. 2 and 3 illustrate other LED driver circuit topologies in which the above-noted dimmer inputs, processing of said inputs, and resulting control of a drive current for the LED can be implemented.

FIG. 2 illustrates another embodiment of an LED system including an LED driven by an LED driver circuit. This embodiment shows a single-stage driver circuit with isolation between the AC mains side of the isolation boundary and the LED on the other side. The single-stage version differs from the dual-stage version in a handful of ways. First, there is no current feedback, and an optional voltage regulator 204 can be coupled to the LED 202 and the processor 226. The optional voltage regulator 204 can extract a portion of power provided to the LED 202 (e.g., 30-40V) and regulate it down to a voltage that can be used to power the processor 226. The optional voltage regulator 204 can also or alternatively provide a voltage across the LED 202 back to the processor 226 as feedback for determining when there is sufficient power being supplied to the LED 202 such that the processor 226 can begin controlling a brightness of the LED 202. When this feedback voltage hits a threshold, then the optional voltage regulator 204 can begin the extraction of power just described. Second, the AC-DC converter and PFC 222 straddles the isolation boundary. That part of the AC-DC converter and PFC 222 that controls the constant DC current that drives the LED 102, is on the AC mains side of the isolation boundary. Therefore, the processor 226 has to pass its LED control signal across the isolation boundary in order to control LED 202 brightness. To accomplish this, a second optical isolator can be used to pass the LED control signal across the isolation boundary from the user side to the AC mains side. Yet, the biggest distinction is the elimination of the DC constant current source sub-system 124. In place of the two driver stages, the single-stage version uses a single AC-DC converter and PFC to both perform the AC-to-DC conversion and also to generate a constant current from the DC signal generated by the AC-to-DC conversion.

FIG. 3 illustrates yet another embodiment of an LED system including an LED driven by an LED driver circuit. This version of the single-stage LED driver circuit 300 is non-isolated. In the non-isolated single-stage LED driver circuit 300 the LED 302 is on the AC mains side of the isolation boundary. Additionally, an XFRMR transformer 350 straddles the isolation boundary, having a primary side on the AC mains side of the isolation boundary, and a secondary side on a processor side of the isolation boundary. This embodiment of the LED driver circuit 300 includes driver circuitry on the non-isolated side of the boundary and control circuitry on the isolated side. The transformer 350 (e.g., a XFRMR transformer or an isolated AC/DC converter than contains a transformer) can take power from an AC mains connection 318 and step it down to a lower isolated voltage that can be used to power the processor 326 and bias inputs of the processor (e.g., 314, 356, 354). For example, the XFRMR transformer 350 may provide 12V power to the voltage regulator 352, which can then provide 10V power to a dedicated dimmer input 314 (e.g., for a 0-10V dimmer input), and 5V or 3.3V for the processor 326. The XFRMR transformer 350 can include circuitry to isolate one side from the other while also providing a step-down of voltage across the isolation boundary.

The processor 326 can use input from the phase detection component 312 to generate an LED control signal that is provided via LED control output 356 to a second optical isolator 358, which then provides the LED control signal to the high voltage buck converter 360. In some embodiments the LED control signal can be a pulse-width modulation (PWM) signal.

In an embodiment, the phase detection component 312 can use natural phase dimming, meaning that any reduction in power on the AC mains connection 318 (e.g., due to reduced on-time caused by an optional phase cut dimmer 306) will reduce the constant current DC to the LED 302 without intervention from the processor 326. In other words, the phase detection component 312 may not be necessary where natural phase dimming is in place.

Figure 5:
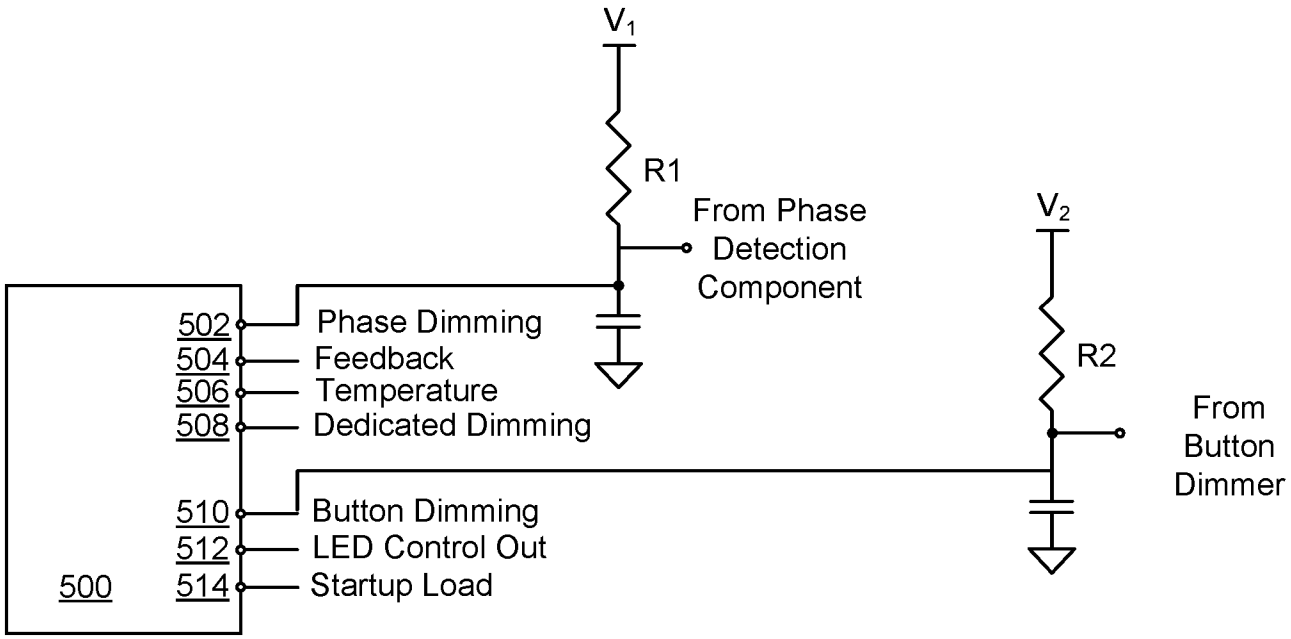
FIG. 5 illustrates an embodiment of a processor (e.g., microcontroller) that can be implemented in any of FIGS. 1-3.

FIG. 5 illustrates an embodiment of a processor (e.g., microcontroller) that can be implemented in any of FIGS. 1-3. The processor 500 can process input signals from the following dimmer types: button dimmer, dedicated dimmer (e.g., 0-10V), phase cut dimmer. The processor 500 can also process feedback in the form of the constant current DC to the LED to aid in control of the LED. Also, and as will be discussed in detail further below, the processor 500 can include a startup load terminal 514 that can be used to enhance phase cut dimming detection during turn-on of the LED.

The processor 500 can include a phase cut dimming input 502 configured to receive a phase cut dimming signal from a phase detection component (e.g., 312). The phase cut dimming input 502 can be coupled between a pull-up resistor R1 and ground, where the resistor R1 is biased by a first pull-up voltage $V_1$. Further, a capacitor can be coupled between the input 502 and ground. Other biasing circuitry can also be implemented to bias the phase cut dimming input 502.

The processor 500 can also include a feedback input 504 for receiving a current or voltage feedback from an output of the LED driver circuit (e.g., output 130 of LED driver circuit 100). The processor 500 can use this indication of the constant current being provided to the LED to adjust the LED control signal and thereby achieve a desired DC constant current output for the LED driver circuit.

The processor 500 can also include a temperature input 506 for receiving a temperature or temperature signal from a temperature sensor coupled to or proximal to the LED. The processor 500 can use the temperature signal to adjust the DC constant current provided to the LED in order to improve a lifetime of the LED.

The processor 500 can further include a dedicated dimming input 508 configured to receive a dedicated dimming signal from the dedicated dimming input (e.g., 114 or 700). Since, the dedicated dimming input (e.g., 114 or 700) can provide a powered signal to the processor 500, no biasing circuit is needed (as compared to the phase cut dimming input 502).

The processor 500 can further include a button dimming input 508 along with biasing circuitry (e.g., R2 and $V_2$). An LED control output 512 and a bleed input 514 can also be included. The LED control output 512 can provide an LED control signal to a DC constant current source (e.g., 124), an AC-DC converter and PFC (e.g., 222), or a high voltage buck converter (e.g., 360).

The startup load input 514 can be turned on when the LED is first turned on. During the first few milliseconds of turn-on, the LED has not lit, and therefore provides an insufficient load to the AC mains for any phase cut dimming signal to be detected (if present). Instead, the AC mains signal will take on some finite DC voltage, and thus no have any phase angle information. After a few milliseconds, the LED lights and presents a load to the AC mains, and the AC mains signal appears as a sinusoidal waveform, and will have a phase cut portion where a phase cut dimmer is employed. However, before the LED is lit and after the light switch or dimmer has been turned on, the processor 500 may not receive a proper indication of the phase dimming signal. To overcome this false identification of dimming, the startup load input 514 can be coupled to AC mains, thereby presenting a small, but sufficient, load to ensure that the AC mains signal has a sinusoidal waveform, and therefore shows any phase cut portion that may be present. Once the LED has lit, the processor 514 can turn the startup load input 514 off, or decouple the same from the AC mains.

Figure 6:
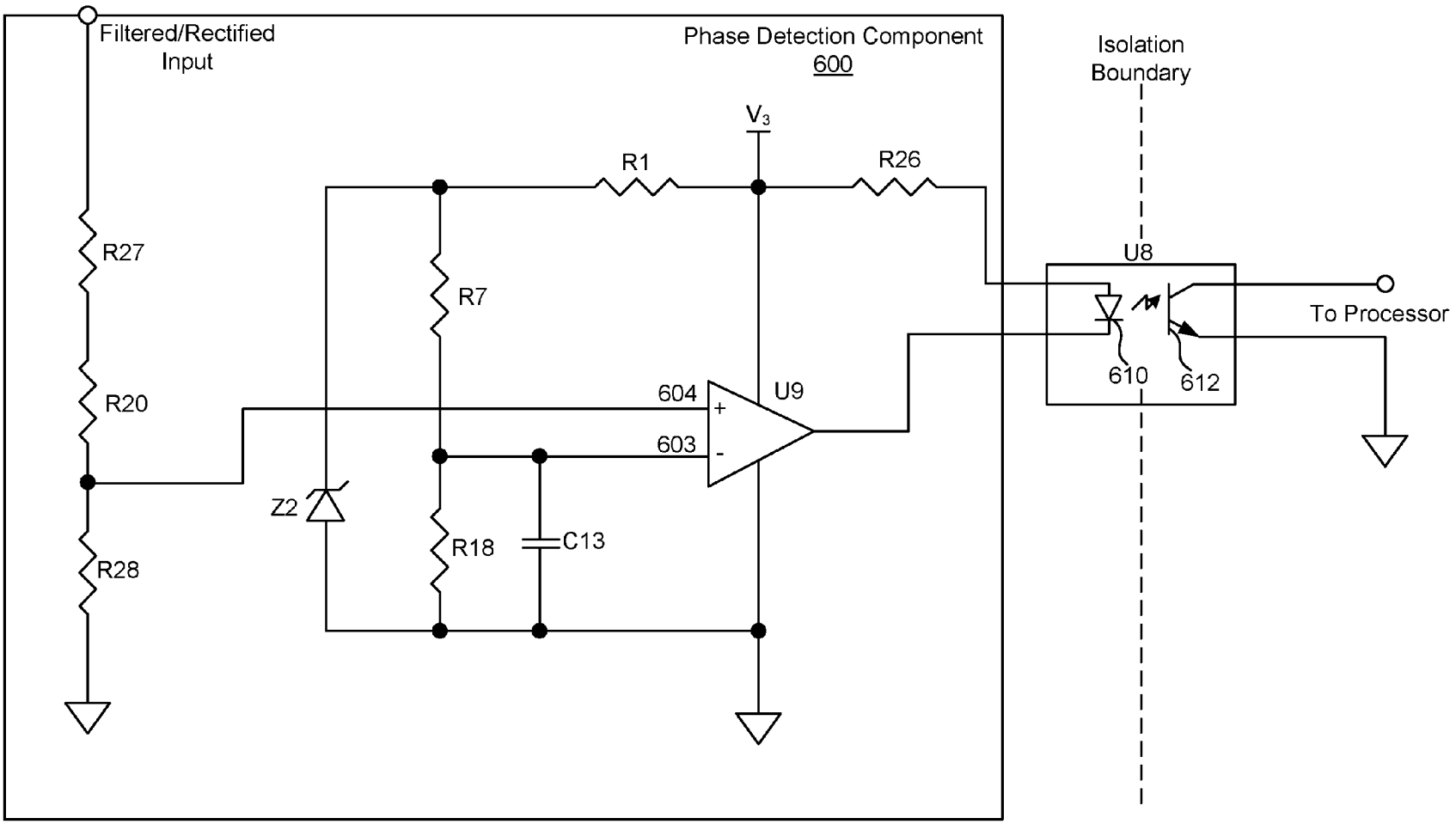
FIG. 6 illustrates an embodiment of a phase detection component that can be implemented in any of FIGS. 1-3.

FIG. 6 illustrates an embodiment of a phase detection component (e.g., 112 or 312) that can be implemented in any of FIGS. 1-3. The AC mains voltage can be rectified and optionally filtered (not illustrated). This rectified voltage can then be divided down, or otherwise reduced to a voltage more amenable to comparator circuits, such as comparator U9. In the illustrated embodiment, a voltage divider, formed from R27, R20, and R28 is used to reduce the voltage from the filtered/rectified input. The divided voltage can then be fed into a non-inverting input 604 of comparator U9 and compared to the inverting input 603, which can be biased to a reference voltage, such as 1V. The reference voltage can represent a voltage below which the rectified AC mains signal can be considered to be effectively 0V, or a phase cut portion of the signal. However, the reference voltage can also be selected to be large enough to avoid noise. In the illustrated embodiment, the reference voltage is formed via a voltage divider including resistors R7 and R18. The reference voltage can also be biased via a Zener regulator including resistor R1 and Zener diode Z2.

To enable passage of data from the phase detection component 600 to the processor across the isolation boundary, an optoisolator (or optical isolator) U8 can be used to pass data across the isolation boundary using an optical signal. The optoisolator U8 can have an LED 610 or other optical source that can be biased high through a resistor R26 for current limiting. The receiving end of the optoisolator U8 can be a transistor 612, biased by the processor (not illustrated). For instance, a pull-up resistor R1 (see FIG. 5) in combination with a voltage source $V_3$ can provide the bias or pull-up voltage that turns the voltage output of transistor 612 into a signal that is received at the phase dimming input terminal 502 of the processor 500. When the voltage at the non-inverting input 604 is larger than the reference voltage at inverting input 603, the comparator U9 provides a high signal which reverse biases the photo LED 610 turning it off. This causes the open collector transistor 612 to be off, and enables a bias on the processor input for the phase detection component (e.g., 134) to be pulled high (e.g., via $V_1$ and R1 in FIG. 5). The collector terminal of the transistor 612 of the optoisolator U8 can be biased high by the processor (not illustrated), and can present a square wave interpretation of the AC input to the phase detection component 600.

When the non-inverting input 4 of comparator U9 is lower than the reference voltage at the inverting input 3, the LED 610 of optoisolator U8 is active, thus activating the transistor 612 of the optoisolator U8. This can pull the input to the processor low. Thus, by biasing the output of the transistor 612 a square wave interpretation of a rectified and filtered AC mains signal can be presented to the processor. The output 614 to the processor can be coupled to the phase detection input 134 in FIG. 1 and/or the phase detection input 502 in FIG. 4.

Figure 7:
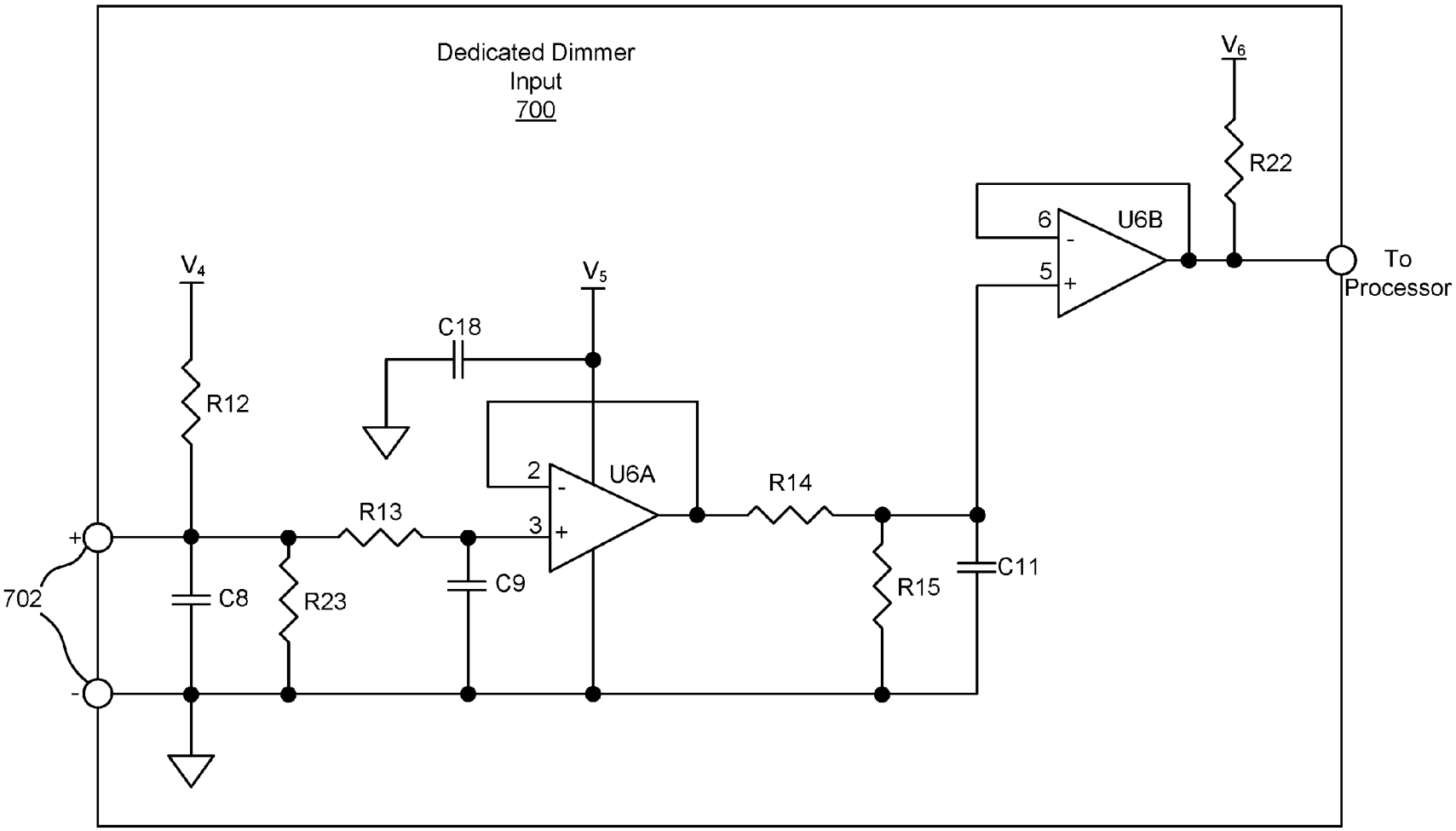
FIG. 7 illustrates an embodiment of a dedicated dimmer component that can be implemented in any of FIGS. 1-3.

FIG. 7 illustrates an embodiment of a dedicated dimmer input 700 (e.g., 114, 314) that can be implemented in any of FIGS. 1-3. The dedicated dimmer input 700 can include an input 702, having two terminals, where a voltage is input across the terminals. In an embodiment, the dedicated dimmer input 700 can be a 0-10V dimmer input, and in this embodiment, the terminals can receive a 0-10V input from a 0-10V dimmer. A positive leg of the input 702 can be provided to a non-inverting input 3 of a first negative feedback amplifier U6A. An output of the first negative feedback amplifier U6A can be combined with any alternating current component of the negative leg of the input 702 (by passing the negative leg through a capacitor C11). This combined signal can then be passed to a non-inverting input 5 of a second negative feedback buffer U6B. An output of the second negative feedback buffer U6B is fed to the processor (e.g., 126, 226, 326). The non-inverting input 3 of the first negative feedback amplifier U6A can be biased by a voltage $V_4$ (e.g., 10V) through resistor R12 until current is drained from the positive leg of the dimmer input 702, which in turn alters an input voltage to the first negative feedback amplifier stage U6A. The dimming signal from the dimming input 702 can be filtered through a low pass filter formed from resistor R13 and capacitor C9 in order to remove high frequency noise, and this filtered signal can be fed into the non-inverting input 3 of the first negative feedback amplifier stage U6A to indicate a 0-10 setting to the processor. The first negative feedback amplifier stage U6A can provide input buffering for the high impedance input of the dimmer. The second negative feedback amplifier stage U6B can provide input buffering for the high impedance voltage divider formed from resistors R14 and R15. Both of these buffering functions are used to avoid loading of an output of a previous stage. $V_4$, $V_5$, and $V_6$ can be three different biases, or one or more of these biases can have the same voltage. For instance, $V_4$ can equal 10V, $V_5$ can equal 10V, and $V_6$ can equal 5V.

Figure 8:
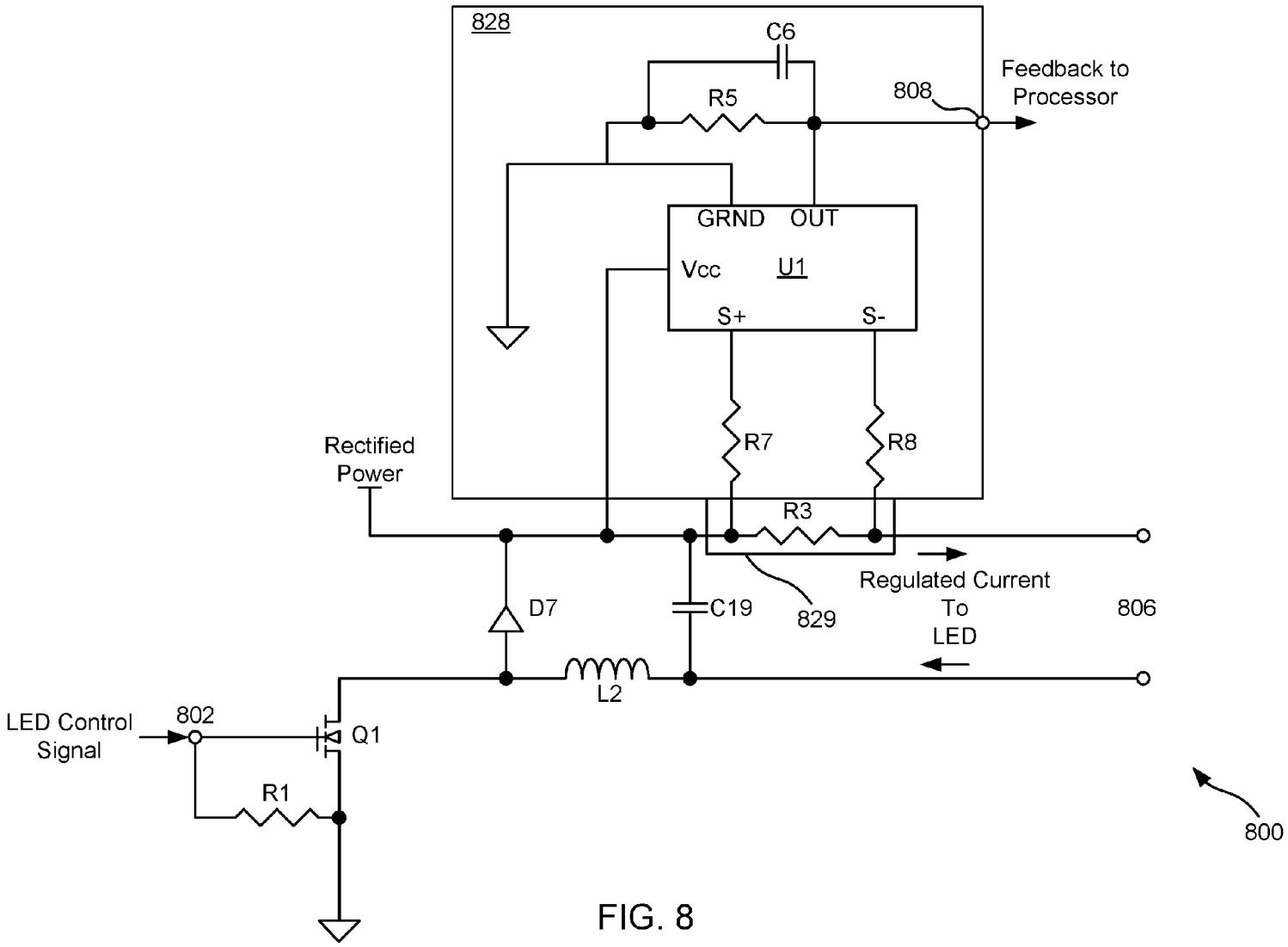
FIG. 8 illustrates an embodiment of an LED driver and current detection component that can be implemented in any of FIGS. 1-3.

FIG. 8 illustrates an embodiment of a DC constant current source (e.g., 124) and current detection component (e.g., 128) that can be implemented in any of FIGS. 1-3. The processor (e.g., 126, 226, 326) controls a regulated current output of the DC constant current source 800 via an LED control signal that can arrive in the form of a pulse-width modulated (PWM) signal at the gate input 802. This gate input 802 controls switching of a switch such, as FET Q1. The duty cycle of the switch determines a current generated by the DC constant current source 800. Rectified power enters the DC constant current source 800 (see "Rectified Power") and a current of this rectified power is regulated by the switch Q1 and maintains a relatively constant current by virtue of having to pass through an inductor L2. The constant current passes through resistor R3 en route to the LEDs via output 806.

A current detection component 828 (e.g., 128 in FIG. 1) can include a current monitoring processor U1 that monitors a voltage between inputs S+ and S−. The output of U1, at the OUT terminal, is related to the voltage between S+ and S− and is thus related to a voltage of the constant current across resistor R3 (e.g., 129). The current from U1 passes through resistor R5, and the processor U1 monitors a voltage between the OUT terminal and the GRND terminal, or a voltage across R5. The ratio of R3 and R5 can be selected such that the current from OUT is representative of the current through R3, and hence provides feedback to the processor, via feedback output 808, indicating the DC constant current being provided to the LED. This feedback output 808 could be coupled to the feedback input 504 of the processor 500 in FIG. 5. The processor can then determine if any changes to the LED control signal provided to input 802 are needed to achieve a desired regulated current to the LED. This circuit contains the DC/DC constant current buck circuit that is directly driven from the same microcontroller that is interpreting the various dimming inputs. All changes to the dimming inputs are translated to this direct control, and current feedback is used for regulation of the LED current.

Although FIG. 8 shows a buck converter implemented as the DC constant current converter, other converters can also be used to generate the constant DC current to drive the LED.

The current detection component 128 can receive signals from a current sensor 129 such as a fixed resistor, variable resistor, inductor, Hall-effect current sensor, or other circuit/device that has a known voltage-current relationship and can provide a measure of current through a load. In alternative embodiments, this current feedback can be supplemented with or replaced with a voltage sensor and voltage feedback.

Figure 9:
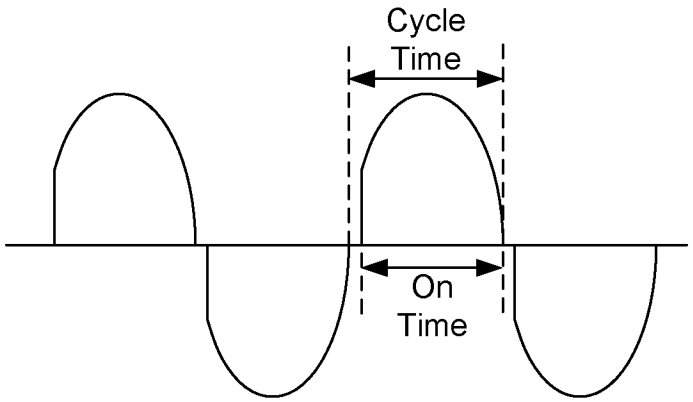
FIG. 9 illustrates a voltage versus time plot showing how on time can be compared to cycle time in order to determine whether a phase cut dimmer is coupled to the LED driver circuit and what the desired dimming level is.

FIG. 9 illustrates a voltage versus time plot showing how on time can be compared to cycle time in order to determine whether a phase cut dimmer is coupled to the LED driver circuit and what the desired dimming level is. In a first embodiment, the on-time can be compared to the cycle period, where the cycle period is assumed to correspond to a known power frequency, such as 60 Hz. However, to increase an accuracy of these measurements, a second embodiment considers the on-time relative to a measured cycle time (rather than assuming the cycle time).

This disclosure is equally applicable to forward and reverse phase cut dimming.

Figure 10:
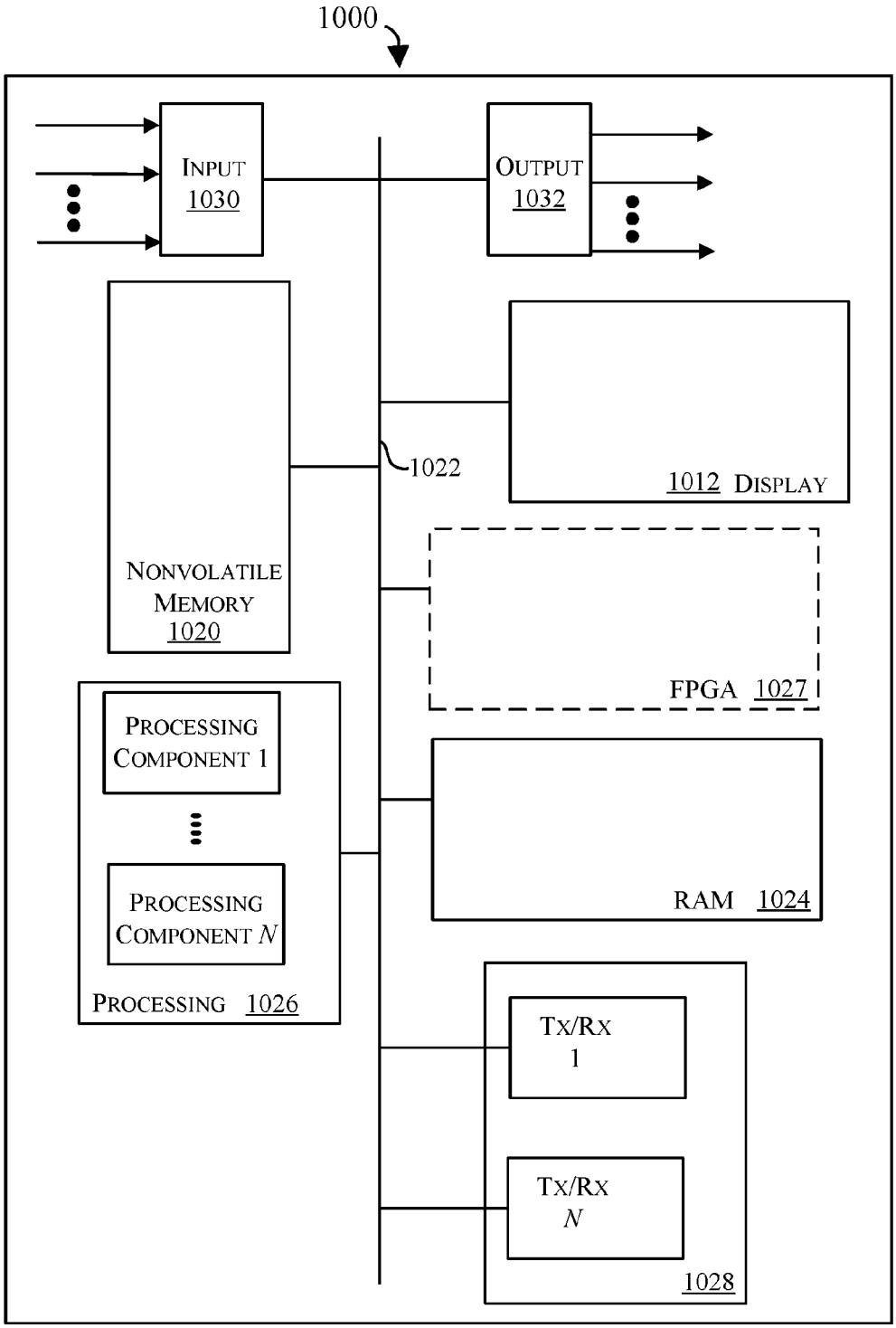
FIG. 10 illustrates an embodiment of a block diagram depicting physical components that may be utilized to realize the LED driver circuits described herein.

The methods described in connection with the embodiments disclosed herein may be embodied directly in hardware, in processor-executable code encoded in a non-transitory tangible processor readable storage medium, or in a combination of the two. Referring to FIG. 10 for example, shown is a block diagram depicting physical components that may be utilized to realize the LED driver circuit (e.g., 100, 200, and 300) according to an exemplary embodiment. As shown, in this embodiment a display portion 1012 and nonvolatile memory 1020 are coupled to a bus 1022 that is also coupled to random access memory ("RAM") 1024, a processing portion (which includes N processing components) 1026, an optional field programmable gate array (FPGA) 1027, and a transceiver component 1028 that includes N transceivers. Although the components depicted in FIG. 10 represent physical components, FIG. 10 is not intended to be a detailed hardware diagram; thus many of the components depicted in FIG. 10 may be realized by common constructs or distributed among additional physical components. Moreover, it is contemplated that other existing and yet-to-be developed physical components and architectures may be utilized to implement the functional components described with reference to FIG. 10.

This display portion 1012 generally operates to provide a user interface for a user, and in several implementations, the display is realized by a touchscreen display. In general, the nonvolatile memory 1020 is non-transitory memory that functions to store (e.g., persistently store) data and processor-executable code (including executable code that is associated with effectuating the methods described herein). In some embodiments for example, the nonvolatile memory 1020 includes bootloader code, operating system code, file system code, and non-transitory processor-executable code to facilitate the execution of a method described with reference to FIGS. 1-9 described further herein.

In many implementations, the nonvolatile memory 1020 is realized by flash memory (e.g., NAND or ONENAND memory), but it is contemplated that other memory types may be utilized as well. Although it may be possible to execute the code from the nonvolatile memory 1020, the executable code in the nonvolatile memory is typically loaded into RAM 1024 and executed by one or more of the N processing components in the processing portion 1026.

The N processing components in connection with RAM 1024 generally operate to execute the instructions stored in nonvolatile memory 1020 to enable the processing portion 1026 to determine which of three dimming modes to enter and to then control a brightness of the LED based on a dimming signal corresponding to the mode entered. For example, non-transitory, processor-executable code to effectuate the methods described with reference to FIG. 4 may be persistently stored in nonvolatile memory 1020 and executed by the N processing components in connection with RAM 1024. As one of ordinarily skill in the art will appreciate, the processing portion 1026 may include a video processor, digital signal processor (DSP), graphics processing unit (GPU), and other processing components.

In addition, or in the alternative, the FPGA 1027 may be configured to effectuate one or more aspects of the methodologies described herein (e.g., the method described with reference to FIG. 4). For example, non-transitory FPGA-configuration-instructions may be persistently stored in non-volatile memory 1020 and accessed by the FPGA 1027 (e.g., during boot up) to configure the FPGA 1027 to effectuate the functions of the processors 126, 226, 326.

The input component 1030 operates to receive signals (e.g., the various dimming/dimmer signals described above) that are indicative of a dimmer type and a dimming control level. The input component 1030 could also operate to receive current or voltage feedback, for instance, from the current detection component 128 or from the voltage regulator 204. The output component 1032 generally operates to provide one or more analog or digital signals to effectuate an operational aspect of the LED driver circuit. For example, the output portion 1032 may provide the LED control signal described with reference to FIGS. 1-3. In some instances, the output portion 1032 can provide a pulse-width modulated signal.

The depicted transceiver component 1028 includes N transceiver chains, which may be used for communicating with external devices via wireless or wireline networks. Each of the N transceiver chains may represent a transceiver associated with a particular communication scheme (e.g., WiFi, Ethernet, Profibus, etc.).

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. An LED driver circuit, the LED driver circuit comprising:

an AC mains connection;

one or more power conversion components including at least a constant current source for driving one or more LEDs;

a phase cut detection component configured to monitor for a phase cut voltage on the AC mains connection;

a dedicated dimmer input configured to monitor for a dedicated dimming voltage from a dedicated dimmer;

a button dimming input configured to monitor for a button dimming signal from a button dimmer;

a processor with one or more processing components, the processor coupled to the phase cut detection component, the dedicated dimmer input, and the button dimming input; and a memory having non-transitory, tangible processor executable code stored on the memory that when executed on the processor causes the processor to:

control the constant current source based on the phase cut voltage, the dedicated dimming voltage, the button dimming signal, or a combination of the dedicated dimming voltage and the button dimming signal;

ignore signals at the button dimmer input if the processor is in a lockout mode; and to enter or exit the lockout mode upon detecting (1) interaction with the button dimmer longer than a first threshold time or (2) a plurality of switch toggles occurring within a second threshold time.

2. The LED driver circuit of claim 1, wherein the dedicated dimmer input is selected from the group consisting of: a 0-10V dimmer input; a pulse-width modulation (PWM) dimmer input; and a digital addressable lighting interface (DALI) dimmer input.

3. The LED driver circuit of claim 1, wherein the button dimmer includes a button, switch, or a touch-sensitive interface and wherein the button dimmer can be coupled to the LED driver circuit or remote from the LED driver circuit.

4. The LED driver circuit of claim 1, wherein the non-transitory, tangible processor executable code, is executable on the processor to cause the processor to determine whether the phase cut dimmer, the dedicated dimmer, or the button dimmer is coupled to the LED driver circuit and trying to control a brightness of the one or more LEDs, and if more than one of these dimmers is coupled to the LED driver circuit and attempting to control the brightness of the one or more LEDs, then:

disabling dedicated dimming and button dimming when there is phase cut dimming; and allowing button dimming when there is dedicated dimming and no phase cut dimming.

5. The LED driver circuit of claim 4, wherein when the dedicated dimmer and the button dimmer are both coupled to the LED driver circuit, the button dimming controls a range of the brightness of the one or more LEDs, and the dedicated dimmer controls the brightness within the range.

6. The LED driver circuit of claim 5, wherein the non-transitory, tangible processor executable code, is executable on the processor to cause the processor to reset the range of brightness of the one or more LEDs when the brightness is at a minimum LED brightness and the button dimmer is further activated.

7. The LED driver circuit of claim 4, wherein the button dimming mode is the default mode of the processor when no other dimming signals are detected.

8. The LED driver circuit of claim 4, wherein the non-transitory, tangible processor executable code, is executable on the processor to cause the processor to monitor for a dedicated dimming signal when the processor is in the button dimming mode.

9. The LED driver circuit of claim 1, wherein the processor is a microcontroller.

10. The LED driver circuit of claim 9, wherein the memory is part of the microcontroller.

11. The LED driver circuit of claim 1, wherein the LED driver circuit is either a single-stage or two-stage LED driver.

12. The LED driver circuit of claim 1, wherein the dedicated dimmer input and the button dimming input are part of the processor.

13. A method of operating an LED driver circuit, the method comprising:

monitoring a phase of an AC mains signal for a phase cut dimming signal, the AC mains signal providing power to the LED driver circuit;

monitoring a dedicated dimming input for a dedicated dimming signal;

monitoring a button dimming input for a button dimming signal;

determining whether a phase cut dimmer, a dedicated dimmer, a button dimmer, or some combination of these is attempting to control the LED brightness;

controlling a constant current source of the LED driver circuit based on the phase cut voltage, the dedicated dimming voltage, the button dimming signal, or a combination of the dedicated dimming voltage and the button dimming signal;

ignoring the button dimmer signal if the LED driver circuit is in a lockout mode; and wherein the LED driver circuit enters or exits the lockout mode upon detecting (1) interaction with a button dimmer longer than a first threshold time or (2) a plurality of switch toggles occurring within a second threshold time.

14. The method of claim 13, wherein the dedicated dimming signal is a 0-10V signal, a pulse-width modulated (PWM) signal, or a digital addressable lighting interface (DALI) signal.

15. The method of claim 13, wherein the button dimming signal is generated by a button dimmer, switched dimmer, or a touch-sensitive interface dimmer.

16. The method of claim 13, wherein when two or more dimmer signals are detected:

disabling the dedicated dimming mode and the button dimming mode when there is phase cut dimming; and allowing the button dimming mode when there is dedicated dimming and no phase cut dimming.

17. The method of claim 16, wherein when dedicated dimming and button dimming are both enabled, the button dimming controls a range of LED brightness, and the dedicated dimming controls the LED brightness within the range.

18. A non-transitory, tangible processor readable storage medium, encoded with processor readable code for controlling an LED driver circuit comprising:

monitoring a phase of an AC mains signal for a phase cut dimming signal, the AC mains signal providing power to the LED driver circuit;

monitoring a dedicated dimming input for a dedicated dimming signal;

monitoring a button dimming input for a button dimming signal;

determining whether a phase cut dimmer, a dedicated dimmer, a button dimmer, or some combination of these is attempting to control an LED brightness;

controlling a constant current source of the LED driver circuit based on the phase cut voltage, the dedicated dimming voltage, the button dimming signal, or a combination of the dedicated dimming voltage and the button dimming signal;

disabling the dedicated dimming mode and the button dimming mode when there is phase cut dimming; and allowing the button dimming mode when there is dedicated dimming and no phase cut dimming.

19. The non-transitory, tangible processor readable storage medium of claim 18, wherein the dedicated dimming signal is a 0-10V signal, a pulse-width modulated (PWM) signal, or a digital addressable lighting interface (DALI) signal.

20. The non-transitory, tangible processor readable storage medium of claim 18, wherein the button dimming signal is generated by a button dimmer, switched dimmer, or a touch-sensitive interface dimmer.

21. The non-transitory, tangible processor readable storage medium of claim 18, further comprising ignoring the button dimmer signal if the LED driver circuit is in a lockout mode.

22. The non-transitory, tangible processor readable storage medium of claim 21, wherein the LED driver circuit enters or exits the lockout mode upon detecting (1) interaction with a button dimmer longer than a first threshold time or (2) a plurality of switch toggles occurring within a second threshold time.

23. The non-transitory, tangible processor readable storage medium of claim 18, wherein when dedicated dimming and button dimming are both enabled, the button dimming controls a range of LED brightness, and the dedicated dimming controls the LED brightness within the range.

24. A method of operating an LED driver circuit, the method comprising:

monitoring a phase of an AC mains signal for a phase cut dimming signal, the AC mains signal providing power to the LED driver circuit;

monitoring a dedicated dimming input for a dedicated dimming signal;

monitoring a button dimming input for a button dimming signal;

determining whether a phase cut dimmer, a dedicated dimmer, a button dimmer, or some combination of these is attempting to control the LED brightness;

controlling a constant current source of the LED driver circuit based on the phase cut voltage, the dedicated dimming voltage, the button dimming signal, or a combination of the dedicated dimming voltage and the button dimming signal;

disabling the dedicated dimming mode and the button dimming mode when there is phase cut dimming; and allowing the button dimming mode when there is dedicated dimming and no phase cut dimming.

25. The method of claim 24, further comprising ignoring the button dimmer signal if the LED driver circuit is in a lockout mode and wherein the LED driver circuit enters or exits the lockout mode upon detecting (1) interaction with a button dimmer longer than a first threshold time or (2) a plurality of switch toggles occurring within a second threshold time.

26. The method of claim 24, wherein the dedicated dimming signal is a 0-10V signal, a pulse-width modulated (PWM) signal, or a digital addressable lighting interface (DALI) signal.

27. The method of claim 24, wherein the button dimming signal is generated by a button dimmer, switched dimmer, or a touch-sensitive interface dimmer.

28. The method of claim 24, wherein when two or more dimmer signals are detected:

disabling the dedicated dimming mode and the button dimming mode when there is phase cut dimming; and allowing the button dimming mode when there is dedicated dimming and no phase cut dimming.

29. The method of claim 28, wherein when dedicated dimming and button dimming are both enabled, the button dimming controls a range of LED brightness, and the dedicated dimming controls the LED brightness within the range.

* * * * *